US005782314A

United States Patent [19]

Zeitler

[11] Patent Number: 5,782,314

[45] Date of Patent: Jul. 21, 1998

[54] STEP LADDER ORGANIZER

[76] Inventor: Gary J. Zeitler, 2447 Liberty Grove Rd., Colora, Md. 21917

[21] Appl. No.: 675,786

[22] Filed: Jul. 5, 1996

[51] Int. Cl.[6] ..... E06C 7/14

[52] U.S. Cl. ..... 182/129; 248/210; 248/238

[58] Field of Search ..... 182/129; 248/210, 248/238

[56] References Cited

U.S. PATENT DOCUMENTS

| | | | |
|---|---|---|---|
| 4,310,134 | 1/1982 | Schopp et al. | 248/210 |
| 4,653,713 | 3/1987 | Hamilton | 248/238 |
| 4,730,802 | 3/1988 | Chatham et al. | 248/238 |
| 4,874,147 | 10/1989 | Ory | 182/129 |
| 4,899,970 | 2/1990 | Berzina | 182/129 |
| 5,282,519 | 2/1994 | Venturo et al. | 182/129 X |
| 5,333,823 | 8/1994 | Joseph | 182/129 |
| 5,342,008 | 8/1994 | Kay | 182/129 |
| 5,505,302 | 4/1996 | Ferley | 182/129 X |

*Primary Examiner*—Alvin C. Chin-Shue
*Assistant Examiner*—Richard M. Smith
*Attorney, Agent, or Firm*—Patent & Trademark Services, Inc.; Joseph H. McGlynn

[57] ABSTRACT

A lightweight organizer with upper and lower trays and receptors for supplies and tools which can be mounted on the top platform of a stepladder. No tools are required in the process. The organizer has four sides extending downward and outwardly and opened on the bottom. It may either be made as single unitary molded plastic structure or its upper tray may be removable from the organizer's lower portion. An interior ledge with a notch in the organizer's apron portion fit on the lower side of the ladder's top platform to firmly secure the mounted organizer to it.

4 Claims, 1 Drawing Sheet

STEP LADDER ORGANIZER

BACKGROUND OF THE INVENTION

The present invention relates to organizer usable with a step ladder. The organizer extends over the top platform of a standard step ladder and is made of a lightweight durable molded plastic material. An interior notched ledge insures a tight fit without the use of tools. Provision is made for tool receptors and for upper and lower supply holding trays.

DESCRIPTION OF THE PRIOR ART

In the prior art various types of ladder attachments are known. Some (U.S. Pat. No. 4,874,147 to Ory et al.)have a utility tray with a pivoted lid and are mounted with screws and nuts to the ladder.

With another (U.S. Pat. No. 4,899,970 to Berzina) a bracket is used with paint can support arms joined to bottom hook means which engages a step or rung of the ladder.

U.S. Pat. No. 5,333,823 to Joseph discloses an apparatus having a plate which removably attaches to the top platform of a stepladder with clips. Still another reference (U.S. Pat. No. 5,342,008 to Kay) discloses channels which engage the ladder.

None, however, disclose a stepladder organizer which fits over and encompasses the upper platform section of the ladder as disclosed herein.

SUMMARY OF THE INVENTION

The present invention consists of a lightweight stepladder organizer having trays and tools holes which fits over the top platform of a stepladder. A ledge with a notch on the interior surface of the organizer's lower apron portion engages the ladder's platform to insure a secure fit. The organizer may either be of a unitary structure molded plastic material or it could be formed by two connected units.

It is an object of the present invention to provide an improved lightweight stepladder organizer.

It is a further object of the present invention to provide an organizer which can be securely mounted on the ladder's top platform without the use tools or fasteners.

It is another object of the present invention to provide an easily mounted organizer having multiple trays and tool receiving receptors.

These and other objects and advantages of the present invention will be fully apparent from the following description, when taken in connection with the annexed drawings.

DESCRIPTION OF THE PREFERRED EMBODIMENT

Figure 1:
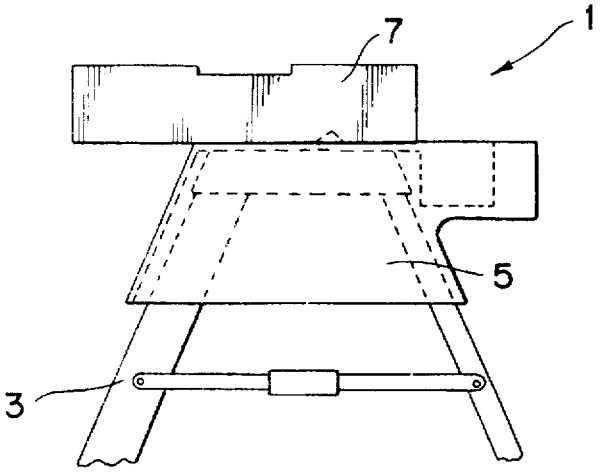
FIG. 1 is a side view of the present organizer invention showing it mounted on the top portion of a stepladder.

Referring now to the drawings in greater detail, FIG. 1 shows a side view of the organizer 1 mounted on a typical stepladder 3. The organizer's lower skirt or apron portion 5 has four sides which extend downward and outward and are configured similar to the ladder's top portion. Its bottom is opened. When placed on the ladder's top platform it would cover the ladder's sides and top. The organizer's upper tray 7 may either be removed or molded into the lower apron portion.

Figure 2:
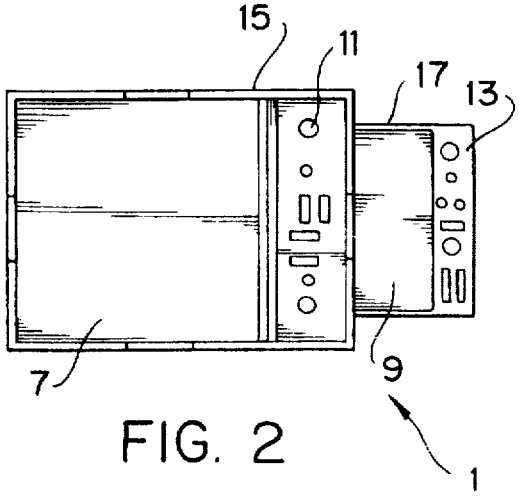
FIG. 2 is a top view of the invention illustrating its trays and tool receptors.

FIG. 2 is a top view of the organizer showing its upper tray 7 and lower tray 9 located on the top of the apron portion. Tool receptors 11 and 13 consisting of notches, holes and slots are located on one side of the upper and lower trays, respectively. The main floor portion of each tray is surrounded by a retaining lip shown as 15 (upper) and 17 (lower). The trays acts as supply holders while the tool receptors can retain various sized and configured tools commonly found around the home and shop such as hammers, pliers, screwdrivers, paint brushes, saws, etc.

Figure 3:
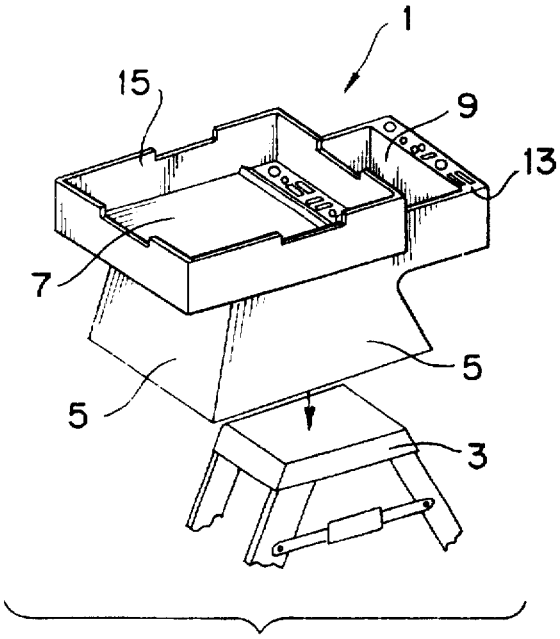
FIG. 3 depicts the organizer in a perspective view and as shows how it is mounted on the top portion of a stepladder.

FIG. 3 shows how the organizer I in a perspective view is mounted over the top platform of a typical stepladder. In doing so the ladder is unmodified and no tools are needed to fasten the organizer to it. The organizer apron opened bottom is simply placed over the ladder's top platform to surround it on the top and four sides. This is done by aligning, tilting and then moving the organizer downward until fit into place.

Figure 4:
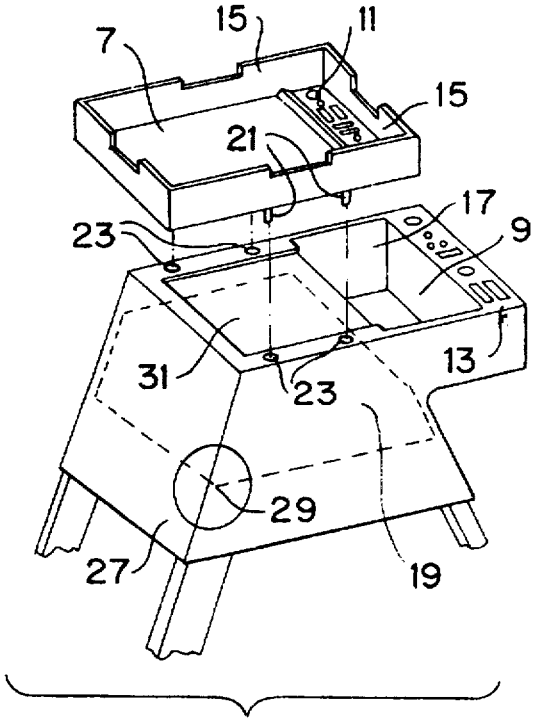
FIG. 4 shows an embodiment with a removal top tray with its lower apron portion enclosing the top portion of the stepladder.

FIG. 4 shows the in-place organizer mounted over the ladder's top platform 19, shown in dotted line format, and extending downward therefrom. In this embodiment the upper tray 7 is removably mounted to the lower apron organizer portion by four projecting pins 21 (two shown) which fit firmly into holes 23 in the upper portion of the lower apron. As an alternative, the upper tray and lower apron portion could be molded as one unitary structure made from molded plastic material.

Figure 5:
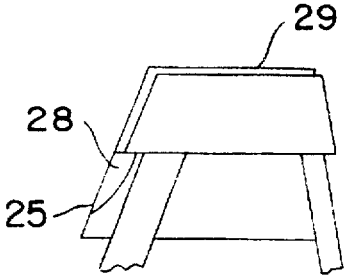
FIG. 5 illustrates the organizer's ledge and shows it mounted on the stepladder's top platform.

The circled portion of FIG. 4 shows an internal horizontal ledge 25 which is best shown in the FIG. 5. The apron's front face surface panel 27 has on its opposite surface an interior integral triangular shaped ledge 25 whose upper horizontal portion 28 forms a notch which runs across the interior length of the panel 27. The ledge's notch fits under the lower edge of the ladder's top platform when in place. To do so, the organizer is aligned over the platform, slightly tilted so that the notch is below the platform and then moved horizontally backward in the direction of the arrow. When this occurs the ledge's notch engages the lower surface of the ladder's top platform. The top platform's upper facing surface 29 engages the bottom surface of the apron's top portion section 31 (see FIG. 4) thereby sitting directly on the top platform. The top platform is thus sandwiched between the apron's surface 31 and the notch 28 in a tight fit. Removal of the organizer is accomplished by moving the organizer forward (left in FIG. 5) until the notch disengages from the platform and then lifting the organizer off the ladder.

Variations as to the type and numbers of tool receptors, configuration of the two trays and how the upper is mounted on the lower apron portion are all possible and contemplated within the scope of my invention. The described preferred embodiment for the organizer's apron has four sides, however, the side opposite the front could either be abbreviated or could have ladder engaging protrusions extending inwardly towards each other. The apron's sides need not be made of a solid material. It may also be necessary to size and configure the organizer's opened apron portion to fit different stepladder's top platforms.

Although the Step Ladder Organizer and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. A lightweight stepladder organizer adapted to fit over a top platform of a stepladder comprising:

a main body portion having a lower downwardly and outwardly extending apron portion having a plurality of sides and an opened bottom configured to fit completely over the top platform of a stepladder and extend downwardly therefrom past the top platform to assist in holding the body to sides of the stepladder below the top platform;

a removable upper tray with tool receptor indentations said tray mounted on said main body portion; and at least one additional lower tray with tool receptor indentations, said lower tray located within the lower apron portion.

2. The organizer as claimed in claim 1, wherein said lower apron portion has a front side surface which extends downward and outward with an extending inner ledge, said ledge being adapted to engage a lower portion of a stepladder's top platform to firmly mount the organizer thereon.

3. The organizer as claimed in claim 1 wherein said organizer is made as a single unitary molded plastic structure.

4. The organizer as claimed in claim 1, wherein the apron has an interior notch which runs across a length of the apron that engages under the stepladder's top platform to assist in holding the organizer to the stepladder.

* * * * *